US006956191B2

(12) United States Patent
Han et al.

(10) Patent No.: US 6,956,191 B2
(45) Date of Patent: Oct. 18, 2005

(54) MICROWAVE OVEN HAVING A PROJECTION DOOR WHICH EXTENDS A COOKING CHAMBER OF THE MICROWAVE OVEN

(75) Inventors: Dae-Sung Han, Hwasung (KR); Yong-Woon Han, Kunpo (KR); Han-Seong Kang, Suwon (KR); Joo-Yong Yeo, Suwon (KR); Seong-Deog Jang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 442 days.

(21) Appl. No.: 10/323,739

(22) Filed: Dec. 20, 2002

(65) Prior Publication Data

US 2004/0031791 A1 Feb. 19, 2004

Related U.S. Application Data

(60) Provisional application No. 60/403,428, filed on Aug. 15, 2002, and provisional application No. 60/403,439, filed on Aug. 15, 2002.

(51) Int. Cl.[7] ..... H05B 6/76

(52) U.S. Cl. ..... 219/685; 219/739; 219/756; 219/740; 219/754; 126/190

(58) Field of Search ..... 217/756, 757, 217/739, 740, 741, 742, 685, 754, 681; 174/35 R, 35 GC; 126/190, 198, 21 A

(56) References Cited

U.S. PATENT DOCUMENTS 3,594,531 A * 7/1971 Hough ..... 219/740
3,943,318 A * 3/1976 Hirai ..... 219/740
4,745,246 A * 5/1988 Hori et al. ..... 219/685
4,817,585 A * 4/1989 Craver ..... 126/200
5,365,918 A 11/1994 Smith et al. ..... 126/21 A
5,632,921 A 5/1997 Risman et al.
6,462,320 B1 * 10/2002 Fuls et al. ..... 219/700
2002/0060219 A1 5/2002 Rypan

FOREIGN PATENT DOCUMENTS

| | | | |
|---|---|---|---|
| DK | 296 10 176 | 12/1996 | |
| DK | 296 10 178 | 12/1996 | |
| EP | 0 848 213 | 6/1998 | |
| FR | 2 542 009 | 9/1984 | |
| GB | 2 266 039 | 10/1993 | |
| JP | 1-184332 | * 7/1989 | ..... 219/740 |

OTHER PUBLICATIONS

U.S. Appl. No. 10/323,740, filed Dec. 20, 2002, Dae–Sung Han et al.

U.S. Appl. No. 10/324,057, filed Dec. 20, 2002, Dae–Sung Han et al.

* cited by examiner

*Primary Examiner*—Philip H. Leung
(74) *Attorney, Agent, or Firm*—Staas & Halsey LLP

(57) ABSTRACT

A microwave oven includes a cooking chamber and a door. The cooking chamber includes a front opening and a bottom plate. The bottom plate is projected forward from the cooking chamber. The door selectively opens and closes the cooking chamber, and is projected forward to form a cooking space extending from the cooking chamber, together with the projected bottom plate of the cooking chamber.

20 Claims, 7 Drawing Sheets

MICROWAVE OVEN HAVING A PROJECTION DOOR WHICH EXTENDS A COOKING CHAMBER OF THE MICROWAVE OVEN

CROSS-REFERENCE TO RELATED APPLICATIONS

This application claims the benefit of patent application Ser. No. 60/403,428 filed on Aug. 15, 2002, and patent application Ser. No. 60/403,439 filed on Aug. 15, 2002, in the United States Patent Office, the disclosure of which is incorporated herein by reference.

BACKGROUND OF THE INVENTION

1. Field of the Invention

The present invention relates a microwave oven, and more particularly, to a microwave oven having a door which is semi-circularly projected forward and a bottom plate which is projected forward from a cooking chamber to correspond to the shape of the door, thus enabling a user to observe the cooking chamber from various locations and allowing food to be easily placed and removed from the cooking chamber.

2. Description of the Related Art

Generally, a microwave oven is an appliance that cooks or heats food laid in a cooking chamber using microwaves that are generated by a magnetron disposed in a machine room. The microwave oven cooks or heats the food using frictional heat produced between moisture molecules of the food, and generated by irradiating the microwaves into the cooking chamber. That is, the microwaves repeatedly change the molecular arrangement of moisture contained in the food to cook the food.

FIG. 1 shows a perspective view of a conventional microwave oven with its door 8 opened. As shown in FIG. 1, the microwave oven comprises a housing 1 having a machine room 2 and a cooking chamber 3 which are partitioned from each other in the interior of the housing 1. A magnetron 4 which generates microwaves, and a blower fan 5 which cools the magnetron 4 and discharges moisture and odor generated from food to the outside of the microwave oven are mounted in the machine room 2. The blower fan 5 discharges the moisture and odor by circulating air through the cooking chamber 3.

The cooking chamber 3 is constructed in a form of a box with its front opened. The cooking chamber 3 has a rectangular bottom 3*a*, a front end of which is laid on the same plane as a front of the cooking chamber 3. A turntable 6 which allows food to be laid thereon, and a rotation guide (not shown) which rotatably supports the turntable 6 are mounted on the rectangular bottom 3*a*. The turntable 6 is rotated at a relatively low speed while being coupled to a motor (not shown) disposed under the cooking chamber 3.

The door 8 is rotatably hinged to one side of the housing 1 in front of the cooking chamber 3 so as to selectively open and close the cooking chamber 3. The door 8 is constructed in a form of a rectangle. A see-through member 9 having a plurality of see-through holes is fitted into a center portion of the door 8 to allow a user to see through the door 8. The door 8 including the see-through member 9 has planar front and back surfaces. Accordingly, where the door 8 is tightly closed, the planar back surface of the door 8 comes into close contact with the front of the cooking chamber 3, and the front of the door 8 constitutes a plane.

Where the microwave oven operates, the microwaves generated by the magnetron 4 are irradiated into the cooking chamber 3, and simultaneously, the turntable 6 is rotated at a relatively low speed. Accordingly, the food laid on the turntable 6 is cooked by the irradiated microwaves.

However, since the conventional microwave oven having the construction as described above is shaped in a form of a hexahedron, and the see-through member 9 formed to allow a user to see through the door 8 constitutes a plane along with the frame of the door 8, the user has to observe the interior of the cooking chamber 3 with his eyes being level with the see-through member, that is, his body being somewhat bent toward the see-through member 9 to ascertain a cooking status of the food.

Additionally, in the conventional microwave oven, the bottom plate 3*a* of the cooking chamber is rectangularly shaped, and a front end of the bottom plate and a front of the cooking chamber 3 are situated on the same plane, so the food has to be positioned deep within the cooking chamber 3. Accordingly, it is difficult to place and remove the food from the cooking chamber 3.

In particular, a cooking container containing the food is very hot after a cooking operation, so it is difficult to remove the cooked food from the cooking chamber 3 of the conventional microwave oven.

Furthermore, the bottom plate 3*a* of the cooking chamber 3 is integrated with a top and sidewalls of the cooking chamber 3. Therefore it is inconvenient and difficult to install a heater to perform a grill cooking. That is, an additional heater structure is required to be installed on or under the bottom plate 3*a* of the cooking chamber 3 to perform the grill cooking. However, the bottom plate 3*a* of the conventional microwave oven is integrated with the cooking chamber 3, and accordingly, the installation of the heater structure is very difficult and complicated.

SUMMARY OF THE INVENTION

Accordingly, it is an aspect of the present invention to provide a microwave oven which allows a cooking status of food being cooked in a cooking chamber to be easily and rapidly ascertained from various locations outside of the microwave oven.

Another aspect of the present invention is to provide a microwave oven which allows food to be easily placed into and removed from a cooking chamber.

Yet another aspect of the present invention is to provide a microwave oven which allows a heater for a grill cooking to be easily installed in conjunction with a bottom plate of a cooking chamber.

Additional aspects and advantages of the invention will be set forth in part in the description which follows and, in part, will be obvious from the description, or may be learned by practice of the invention.

To achieve the above and/or other aspects of the present invention, there is provided a microwave oven comprising a heating unit to cook food, a cooking chamber having an opening and a bottom plate which is projected forward from the cooking chamber, and a door which selectively opens and closes the opening of the cooking chamber, wherein the door is projected forward to form a cooking space extending from the cooking chamber, together with the projected bottom plate of the cooking chamber.

The door may comprise a frame which is constructed to come into contact with a rim of the opening around the cooking chamber, and a see-through member which is constructed to cover the opening of the cooking chamber. The see-through member may comprise a front plate which is projected forward from the cooking chamber, and top and bottom plates which are constructed to cover a corresponding top and a bottom of an inner space formed in front of the cooking chamber. The bottom plate of the cooking chamber may comprise a front part which is positioned in front of the cooking chamber and a rear part which is positioned in the cooking chamber.

The front part of the bottom plate of the cooking chamber may be shaped in a form of a semi-circle.

The rear part of the bottom plate of the cooking chamber may be shaped in a form of a semi-circle or a rectangle.

The bottom plate of the cooking chamber may be integrated with the cooking chamber to form a bottom of the cooking chamber.

The bottom plate of the cooking chamber may be separately manufactured and attached to a bottom of the cooking chamber.

The bottom plate of the cooking chamber may include a plurality of internally threaded bosses which are provided at corresponding areas of a lower surface of the bottom plate of the cooking chamber, so as to attach the bottom plate of the cooking chamber to the bottom of the cooking chamber.

The bottom plate of the cooking chamber may be made of aluminum.

The microwave oven may further comprise a turntable for receiving the food thereon, and a rotating shaft which is coupled to the turntable to rotate the turntable, wherein the bottom plate of the cooking chamber includes a downwardly concave recess which receives the turntable, and the recess is provided with a through hole so as to couple the rotating shaft to the turntable therethrough.

The turntable may be partially positioned on the front part of the bottom plate of the cooking chamber so as to have the through hole be positioned on a boundary line of the front and rear parts of the bottom plate of the cooking chamber.

The front plate of the see-through member may be shaped in a form of a half-cylinder to correspond to the form of the front part of the bottom plate of the cooking chamber, and the top and bottom plates of the see-through member may each be shaped in a form of a semi-circle to correspond to the form of the front part of the bottom plate of the cooking chamber, so as to have the front part of the bottom plate of the cooking chamber be positioned over the bottom plate of the see-through member in response to the door being closed.

The front and top plates of the see-through member may include a plurality of see-through holes which provide optical views into an interior of the cooking chamber, at least from locations in front of, both sides of and above the microwave oven.

The see-through holes may be formed across an entire area of the see-through member so as to allow an effective visual view of the interior of the cooking chamber.

The frame may be sized so as not to obstruct the front opening of the cooking chamber.

The heating unit may include a heater which is disposed under the bottom plate of the cooking chamber.

The microwave oven may further include an insulating member which is disposed under the heater and transmits heat generated by the heater upward.

The heater may be attached to an upper surface of the insulating member and brought into contact with the bottom plate of the cooking chamber.

The heating unit may include a heater which is integrated into the bottom plate of the cooking chamber, and the heater may be integrated into the bottom plate of the cooking chamber through a die-casting process.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
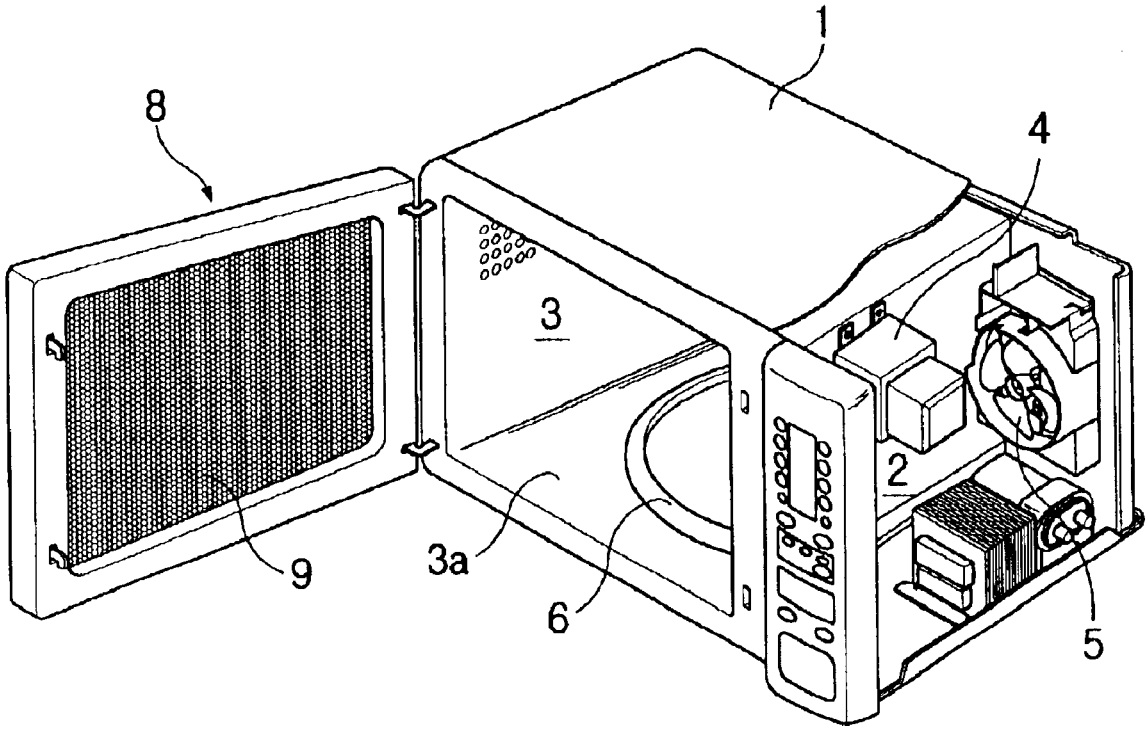
FIG. 1 (PRIOR ART)
FIG. 1 is a perspective view of a conventional microwave oven with its door being opened.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
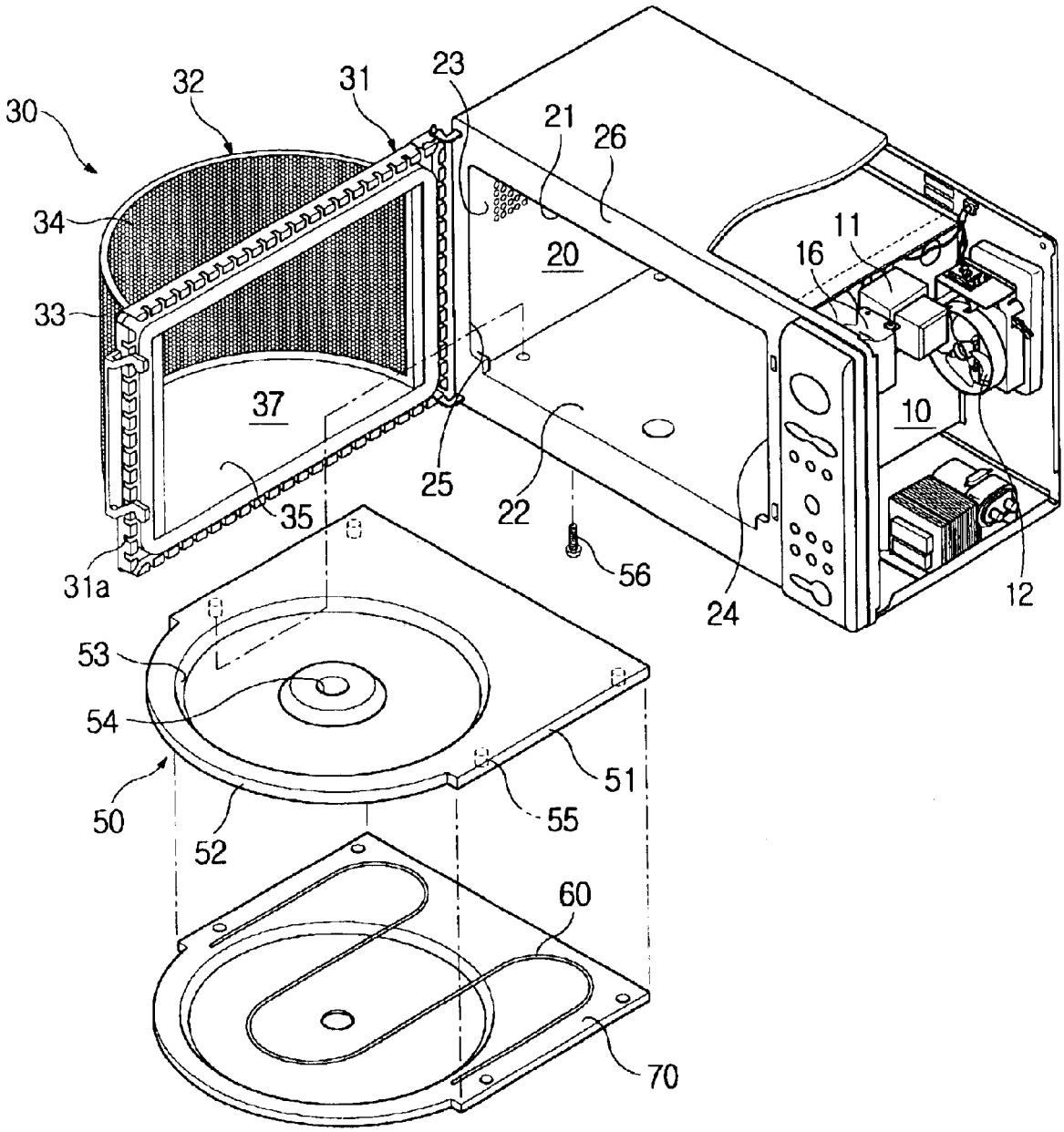
FIG. 2 is an exploded perspective view of a microwave oven having a heater, a separate bottom plate, and an insulating member which support the heater according to an embodiment of the present invention.
Figure 4:
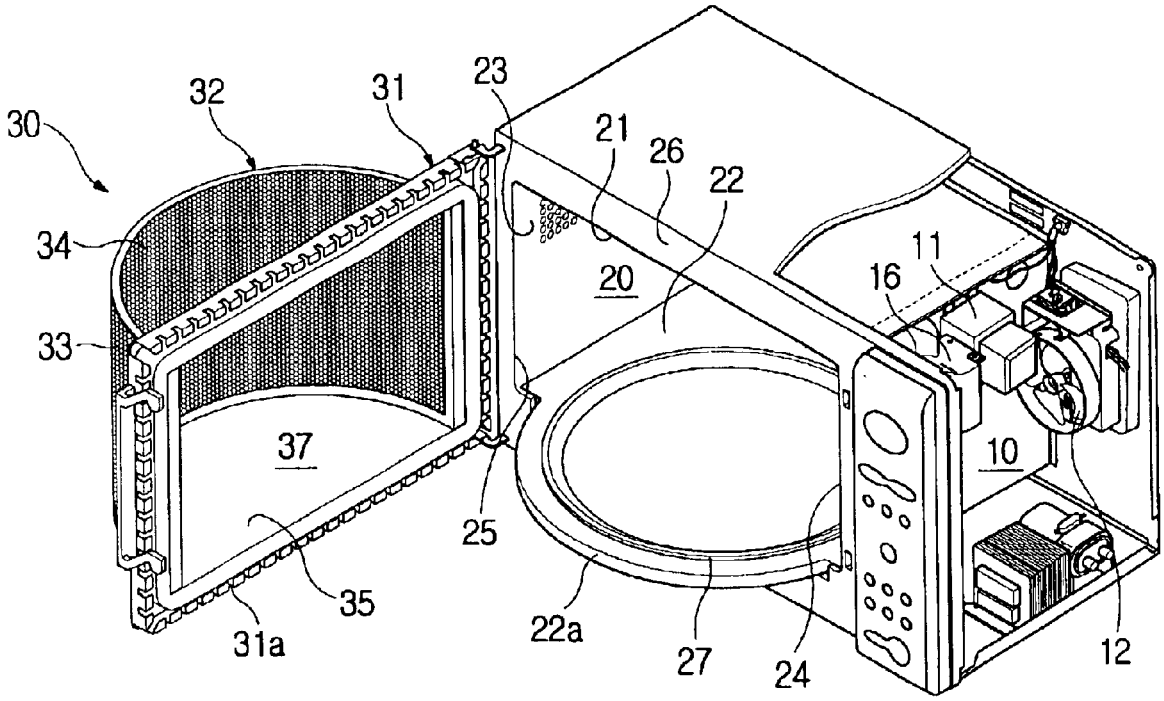
FIG. 4 is a perspective view of one of the microwave ovens shown in FIGS. 2 and 3 with the bottom plate, the heater, and the insulating member being attached to a bottom of a cooking chamber.

FIG. 2 shows an exploded perspective view of a microwave oven having a separate bottom plate 50 and an insulating member 70 which supports a heater 60 of the microwave oven, according to an embodiment of the present invention. FIG. 4 shows a perspective view of the microwave oven shown in FIG. 2 with the bottom plate 50, the heater 60 and the insulating member 70 being attached to a bottom 22 of a cooking chamber 20.

As shown in FIG. 2, the microwave oven comprises a machine room 10 in which various electrical parts are mounted to generate microwaves, the cooking chamber 20 which provides a space to cook food and has an opened front, and a door 30 which selectively opens and closes the cooking chamber 20.

The machine room 10 includes a magnetron 11 which generates the microwaves, and a blower fan 12 which cools the magnetron 11 and discharges moisture and odor generated from the food to the outside of the microwave oven.

The cooking chamber 20 is defined by a top 21, the bottom 22, sidewalls 23 and 24 and a rear wall (not shown).

Additionally, the cooking chamber 20 is provided with a front opening 25 to allow the front of the cooking chamber 20 to be opened. The door 30 is rotatably hinged to the front of the cooking chamber 3 so as to selectively open and close the front opening 25. A rectangular rim 26 is formed around the front opening 25 of the cooking chamber 20 so as to tightly close the front opening 25 by coming into close contact with a frame 31 of the door 30, where the door 30 is closed.

A separate bottom plate 50 is attached to the bottom 22 of the cooking chamber 20. The bottom plate 50 comprises a rear part 51 which is rectangularly shaped and disposed on the bottom 22 of the cooking chamber 20, and a front part 52 which is semi-circularly shaped and horizontally extends forward from the rear part 51. Accordingly, where the rear part 51 of the bottom plate 50 is disposed on the bottom 22 of the cooking chamber 20, the front part 52 of the bottom plate 50 is horizontally projected from the cooking chamber 20, that is, extended away from the front of the cooking chamber 20.

A downwardly concave recess 53 is formed on the bottom plate 50 to allow a turntable 27 (see FIG. 4) to be disposed therein. A center of the recess 53 is positioned on a boundary line of the rear and front parts 51 and 52 of the bottom plate 50. A through hole 54 is formed at the center of the recess 53 to allow a rotating shaft (not shown) coupled to a motor (not shown) positioned under the cooking chamber 20 to be extended through the bottom plate 50.

A plurality of internally threaded bosses 55 are formed on, for example, a lower side of the bottom plate 50, so as to secure the bottom plate 50 to the bottom 22 of the cooking chamber 20 by associated screws 56 tightened through the bottom 22 of the cooking chamber 20.

The bottom plate 50 is made of, for example, aluminum, and may be manufactured through a die casting process.

As shown in FIG. 4, a center of the turntable 27 is situated near the front of the cooking chamber 20 due to the structure of the bottom plate 50. Accordingly, it is convenient to place food into and remove the food from the cooking chamber 20 as compared with a conventional microwave oven in which food is positioned deep within a cooking chamber.

Referring back to FIG. 2, the door 30 includes the frame 31 and a see-through member 32. The frame 31 has a rectangular shape so as to prevent a leakage of the microwaves while being in close contact with the rectangular rim 26 that defines the front opening 25 of the cooking chamber 20. The see-through member 32 is fitted into an opening of the frame 31 and allows a user to see through the door 30 so as to ascertain a cooking status of the food in the cooking chamber 20.

A plurality of choke slits 31 a are formed along an inner edge of the frame 31. The choke slits 31*a* prevent a leakage of the microwaves where the frame 31 is brought into contact with the rectangular rim 26 of the front of the cooking chamber 20.

The see-through member 32 comprises a front plate 33 which is, for example, half-cylindrically projected forward, a top plate 34 which is laid on a top of the front plate 33 to cover a top of an inner space formed inside the front plate 33, and a bottom plate 35 which is laid under a bottom of the front plate 33 to cover the bottom of the inner space.

Accordingly, where the door 30 closes the cooking chamber 20, the front part 52 of the bottom plate 50 of the cooking chamber 20 is positioned over the bottom plate 35 of the see-through member 32, and the interior of the half-cylindrical see-through member 32 forms a cooking space 37.

That is, the cooking space 37 is formed by the see-through member 32 of the door 30 and the front part 52 of the bottom plate 50 which projects forward from the cooking chamber 20. Accordingly, a length of the cooking chamber 20 can be shortened by a length corresponding to the length of the front part 52 of the bottom plate 50. In this case, the entire length of the cooking chamber 20 and the cooking space 37 can be kept at the same length as that of a conventional cooking chamber. Alternatively, where a length of the rear part 51 of the bottom plate 50 is made to be the same as the length of the conventional cooking chamber, the length of the cooking chamber 20 is made to be greater than that of the conventional cooking chamber, thus enlarging a cooking chamber.

A plurality of see-through holes are closely arranged on the front and top plates 33 and 34 of the see-through member 32 to allow a user to see through the door 30. Therefore, the user can observe the interior of the cooking chamber 20 through the front and top plates 33 and 34 of the see-through member 32. That is, with the microwave oven of the present invention, the user can observe the interior of the cooking chamber 30, for example, from the above and sides of the microwave oven, as well as directly in front of the microwave oven. Accordingly, the user can ascertain the cooking status of the food laid in the cooking chamber 20 while carrying out other tasks near the microwave oven.

A transparent panel (not shown) made of a transparent material may be attached to an outside surface of the see-through member 32, so as to prevent the interior of the cooking chamber 20 from communicating with the exterior of the microwave oven, through the see-through holes formed on the see-through member 32, and enable the user to observe the interior of the cooking chamber 20 through the see-through member 32.

Although the see-through holes have been described as not being formed on the bottom plate 35 of the see-through member 32, in consideration of the fact that the microwave oven is generally placed at a position level with or below the eye-level of the user in a cooking space, the see-through holes may be formed on the bottom plate 35 so as to provide an additional plane of view to view the interior of the cooking chamber 20.

The heater 60 which is used for, for example, a grill cooking and the insulating member 70 which transmits heat generated by the heater 60 upward are disposed under the bottom plate 50. The insulating member 70 is shaped to correspond to that of the bottom plate 50, and is attached to the bottom plate 50. The heater 60 is positioned on the insulating member 70 to come into contact with the bottom plate 50, so as to heat the bottom plate 50.

Since the heater 60 and the insulating member 70 attached to the bottom plate 50 are positioned on the bottom 22 of the cooking chamber 20, the microwave oven of the present invention can carry out a grill cooking as well as a microwave cooking.

As shown in FIG. 4, the turntable 27 which allows the food to be laid thereon and a rotation guide (not shown) which rotatably supports the turntable 27 are mounted on the bottom plate 50. The turntable 27 is coupled to a rotating shaft inserted through the through hole 54 formed at the center of the bottom plate 50, and is rotated at a relatively low speed to allow the microwaves to irradiate and cook the food.

Where the heater 60 positioned under the bottom plate 50 is operated, the bottom plate 50 is heated by the heater 60. The heat generated by the heater 60 is transmitted to the food, and the microwave oven of the present invention can carry out a grill cooking along with a microwave cooking described above. It is also understood that only a grill cooking can be carried out by operating only the heater 60.

Figure 3:
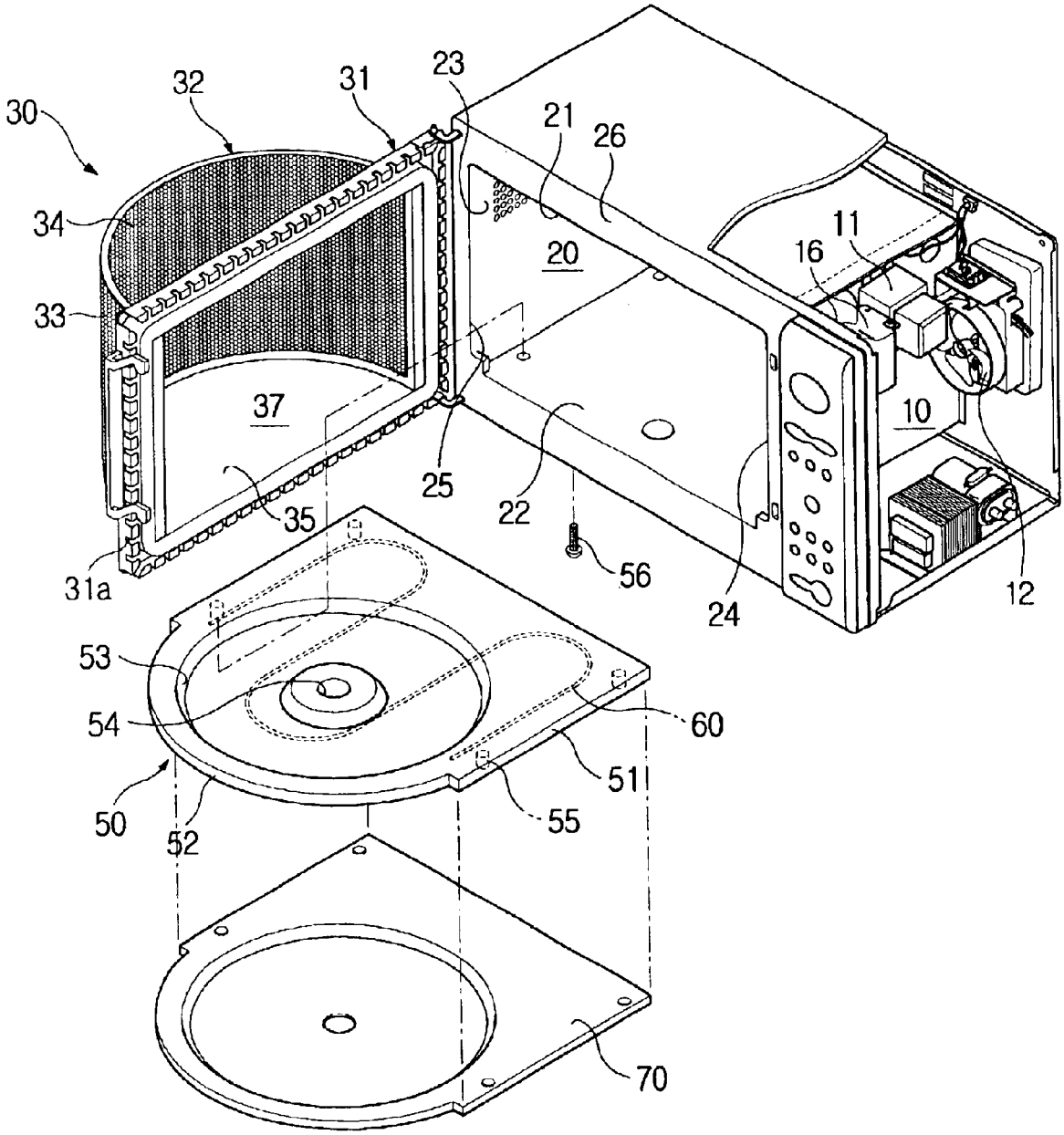
FIG. 3 is an exploded perspective view of a microwave oven having a separate bottom plate which includes a heater and an insulating member according to another embodiment of the present invention.

FIG. 3 shows an exploded perspective view of a microwave oven having a separate bottom plate 50 which includes a heater 60, and an insulating member 70 according to another embodiment of the present invention. As shown in FIG. 3, the heater 60 is not disposed on the insulating member 70. Rather, the heater 60 is inserted into the bottom plate 50 while the bottom plate 50 is manufactured through, for example, a die casting process, thus integrating the heater 60 with the bottom plate 50.

In accordance with the embodiment of FIG. 3, a thermal efficiency of the microwave oven is improved because heat generated by the heater 60 is directly transmitted to the bottom plate 50. The heater 60 can also be simply and conveniently installed because the heater 60 is inserted into the bottom plate 50 at the time of manufacturing the bottom plate 50.

Although the bottom plate 50 has been described as being separately manufactured and attached to the bottom 22 of the cooking chamber 20, using the associated screws 56, the bottom plate 50 can be integrated with the bottom 22 of the cooking chamber 20 with its front part 52 projected forward from the cooking chamber 20.

Figure 5:
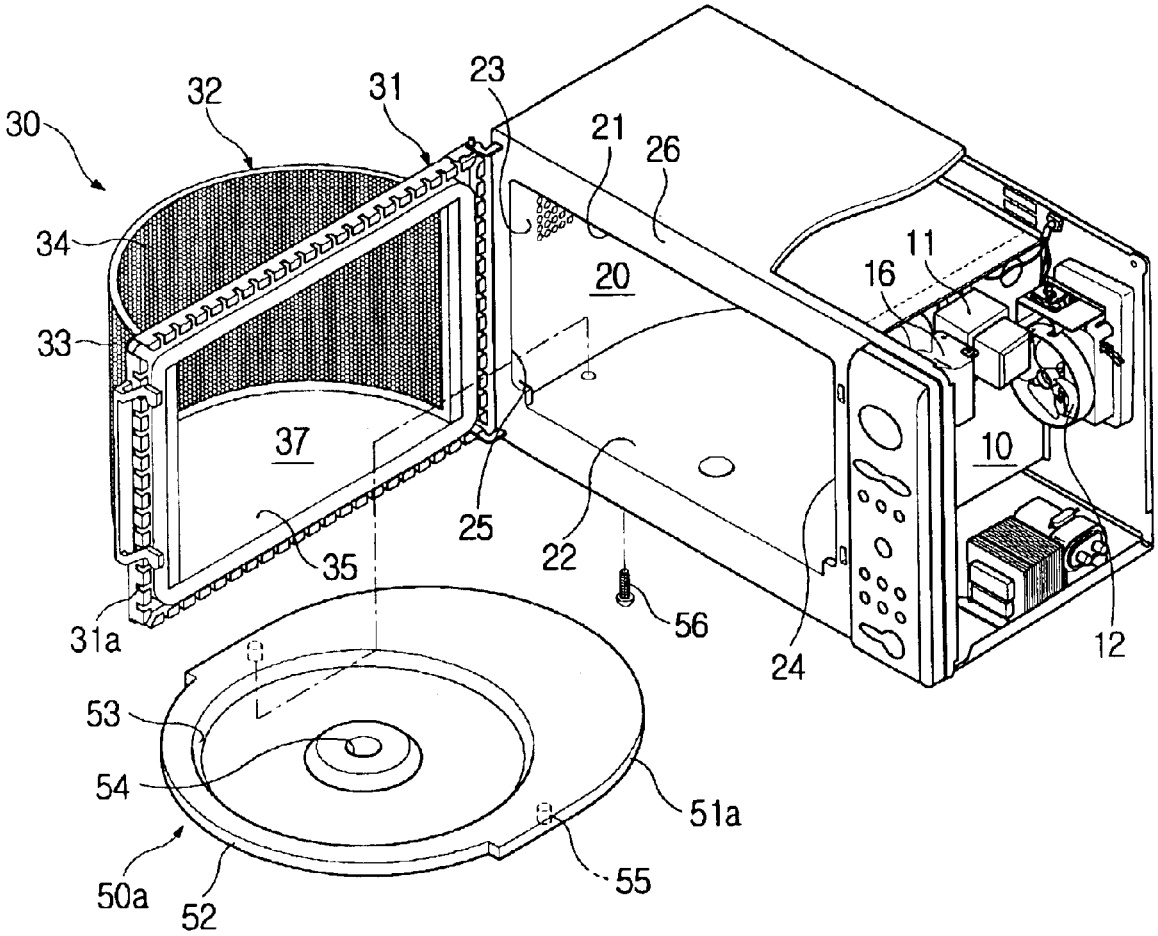
FIG. 5 is a perspective view of a microwave oven having front and rear parts of a bottom plate of a cooking chamber being semi-circularly shaped according to yet another embodiment of the present invention.

FIG. 5 shows a perspective view of a microwave oven having front and rear parts 52 and 51*a* of a bottom plate 50*a* which have a circular shape. As shown in FIG. 5, the rear part 51*a* of the bottom plate 50*a* as well as the front part 52 are semi-circularly shaped. A back wall of a cooking chamber 20 can be semi-circularly shaped to correspond to the semi-circular shape of the rear part 51*a* of the bottom plate 50*a*.

Figure 6:
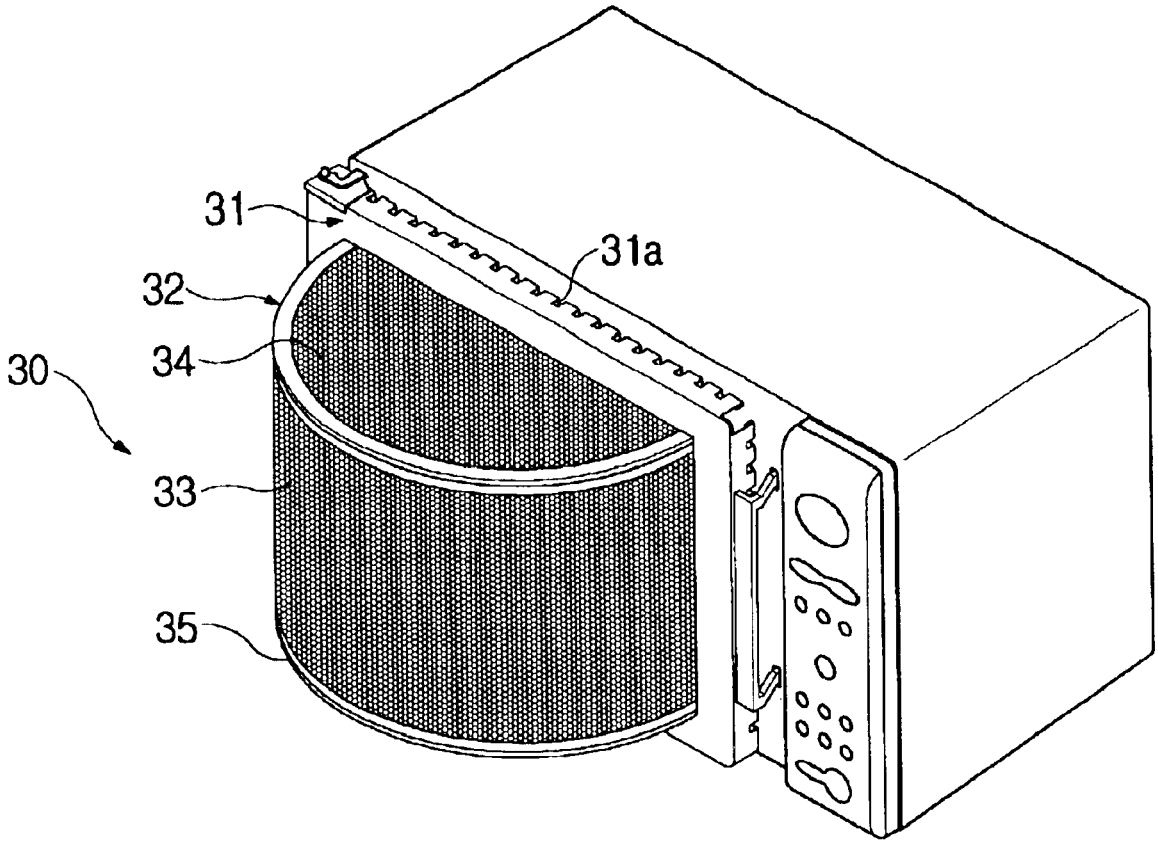
FIG. 6 is a perspective view of one of the microwave ovens shown in FIGS. 2 through 5 with its door being closed.

FIG. 6 shows a perspective view of one of the microwave ovens shown in FIGS. 2 through 5 with its door being closed. Where the door 30 is closed as shown, the front part 52 of the bottom plate 50 or 50*a* mounted on the bottom 22 of the cooking chamber 20 is projected forward and laid over the bottom plate 35 of the see-through member 32, so the cooking space 37 is formed to be connected to the cooking chamber 20.

Accordingly, the interior of the cooking chamber 20 can easily be observed from various locations, including from the above and sides of the microwave oven. Furthermore, the food can be easily removed from the cooking chamber 20 because the food is situated to be partially projected forward from the cooking chamber 20.

Additionally, the above-described structure prevents the moisture generated from the food from condensing on the inside surface of the see-through member 32.

Figure 7:
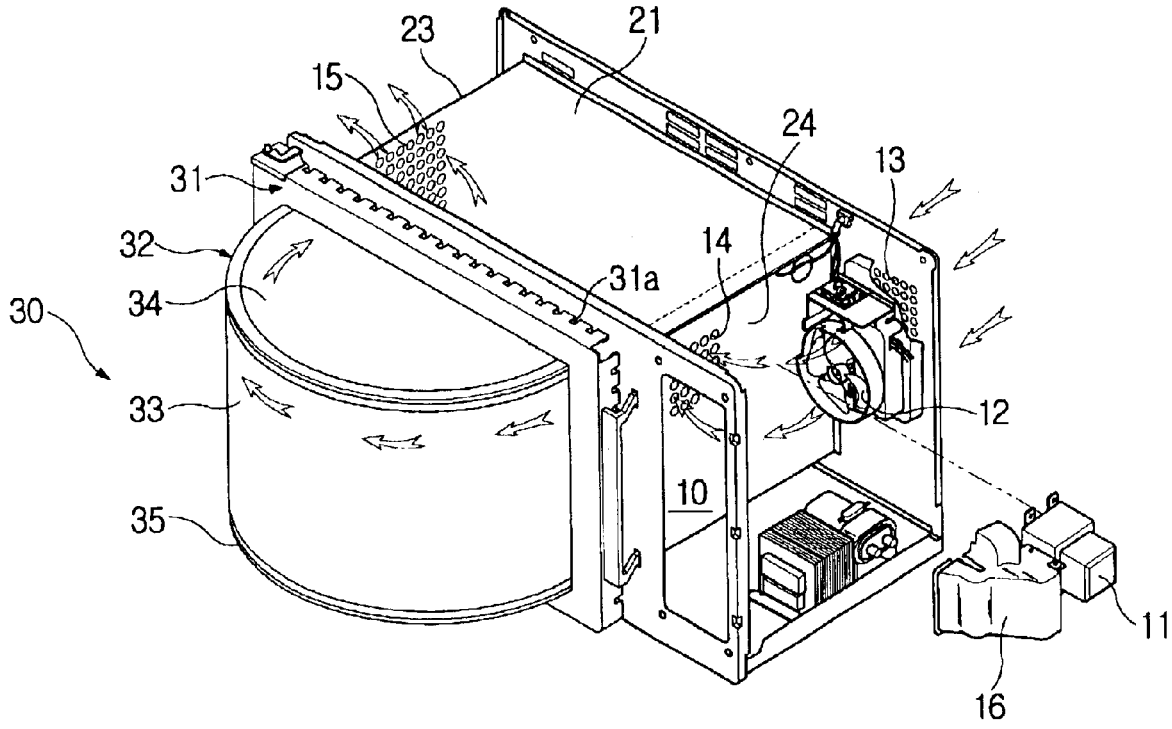
FIG. 7 is a perspective view of a microwave oven of the present invention illustrating a flow of air that is fed into a machine room, passed through a cooking chamber, circulated through the cooking chamber, and discharged from the cooking chamber.

FIG. 7 shows a perspective view of one of the microwave ovens shown in FIGS. 2 through 5, illustrating a flow of air that is fed into the machine room 10, passed through the cooking chamber 20, circulated through the cooking chamber 20, and discharged from the cooking chamber 20 to the outside of the microwave oven.

As illustrated in the drawing, to suck outside air into the interior of the machine room 10, pass the air through the cooking chamber 20 and discharge the air from the cooking chamber 20 to the exterior of the microwave oven, a plurality of inlet holes 13 are formed on a rear wall of the machine room 10. Additionally, air feed holes 14 and air discharge holes 15 are formed on a right sidewall 24 and a left sidewall 23 of the cooking chamber 20, respectively.

The blower fan 12 is positioned in front of the inlet holes 13 formed on a rear wall of the machine room 10 to suck the outside air into the interior of the machine room 10. The air feed holes 14 formed on the right sidewall 23 of the cooking chamber 20 are arranged near a front of the cooking chamber 20, so as to guide the air to the see-through member 32 of the door 30 and allow the air to flow smoothly along an arcuate inside surface of the see-through member 32. Additionally, the air discharge holes 15 formed on the left sidewall 24 of the cooking chamber 20 are arranged near the front of the cooking chamber 20 in the same manner as the air feed holes 14, so as to allow the air flown along the see-through member 32 to smoothly discharge from the cooking chamber 20 to the outside of the microwave oven. The magnetron 11 is disposed between the inlet holes 13 and the air feed holes 14. An air guide duct 16 is disposed between the magnetron 11 and the air feed holes 14, so as to guide the air having passed the magnetron 11 to the air feed holes 14, and feed the air to the interior of the cooking chamber 20.

By having an air circulation structure of the microwave oven as described above, air fed into the cooking chamber 20 can smoothly flow along the arcuate inside surface of the see-through member 32, and the moisture generated from the food being cooked can be rapidly discharged through the air discharge holes 15, together with the air flowing along the front and top plates 33 and 34 of the see-through member 32. Accordingly, the air circulating structure effectively prevents the moisture from condensing on the inside surface of the see-through member 32. Consequently, the user can more clearly observe the food laid in the cooking chamber 20 through the see-through member 32.

As described above, the present invention provides a microwave oven having a front plate of a door which is constructed to be semi-circularly projected forward, and top and bottom plates of the door which cover a corresponding top and bottom of an inner space formed inside the half-cylindrical front plate of the door. Accordingly, the interior of a cooking chamber can be observed from a variety of viewing locations or angles, enabling a user to rapidly ascertain a cooking status of the food from various locations outside of the microwave oven.

In addition, in the microwave oven of the present invention, a front part of a bottom plate of the cooking chamber is semi-circularly projected forward from the cooking chamber to correspond to the shape of the bottom plate of the door. Accordingly, the food is partially projected forward from the cooking chamber so as to allow the user to conveniently place or remove the food from the cooking chamber. Therefore, the user can more easily handle the food, especially where the food is hot from a cooking operation.

Furthermore, in the microwave oven of the present invention, a heater can be easily installed in conjunction with the bottom plate attached to the cooking chamber, as compared to a conventional microwave oven having a bottom plate that is integrated as part of a cooking chamber.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven, comprising:

a cooking chamber having an opening and a bottom plate which is projected forward from the cooking chamber;

a heating unit to cook food and having a heater disposed under the bottom plate projecting from the cooking chamber; and a door which selectively opens and closes the opening of the cooking chamber, wherein the door is projected forward to form a cooking space extending from the cooking chamber, together with the projected bottom plate of the cooking chamber, and wherein the door comprises:

a see through member to cover the opening of the cooking chamber and includes a front plate which projects forward from sidewalls of the cooking chamber and a top plate connected to the front plate at a top end thereof such that the front and top plates are see-through and the cooking chamber is viewable through the front and top plates.

2. The microwave oven according to claim 1, wherein:

the door comprises:

a frame which is constructed to come into contact with a rim of the opening cooking chamber;

the see-through member further comprises:

the top plate and a bottom plate which are constructed to cover a corresponding top and bottom of an inner space formed in front of the cooking chamber; and the bottom plate of the cooking chamber comprises:

a front part which is positioned in front of the cooking chamber, and a rear part which is positioned in the cooking chamber.

3. The microwave oven according to claim 2, wherein the front part of the bottom plate of the cooking chamber is shaped in a form of a semi-circle.

4. The microwave oven according to claim 3, wherein the bottom plate of the cooking chamber is integrated with the cooking chamber to form a bottom of the cooking chamber.

5. The microwave oven according to claim 3, wherein the bottom plate of the cooking chamber is separately manufactured and attached to a bottom of the cooking chamber.

6. The microwave oven according to claim 5, wherein the bottom plate of the cooking chamber includes a plurality of internally threaded bosses which are provided at corresponding areas of a lower surface of the bottom plate of the cooking chamber, so as to attach the bottom plate of the cooking chamber to the bottom of the cooking chamber.

7. The microwave oven according to claim 5, wherein the bottom plate of the cooking chamber is made of aluminum.

8. The microwave oven according to claim 5, further comprising an insulating member which is disposed under the heater and transmits heat generated by the heater upward.

9. The microwave oven according to claim 8, wherein the heater is attached to an upper surface of the insulating member and brought into contact with the bottom plate of the cooking chamber.

10. The microwave oven according to claim 5, the heating unit includes a heater which is integrated into the bottom plate of the cooking chamber.

11. The microwave oven according to claim 10, wherein the heater is integrated into the bottom plate of the cooking chamber through a die-casting process.

12. The microwave oven according to claim 5, wherein:

the heating unit further includes a magnetron which generates microwaves to cook the food, and the heater generates heat to cook the food.

13. The microwave oven according to claim 3, wherein:

the front plate of the see-through member is shaped in a form of a half-cylinder to correspond to the form of the front part of the bottom plate of the cooking chamber, and the top and bottom plates of the see-through member are each shaped in a form of a semi-circle to correspond to the from of the front part of the bottom plate of the cooking chamber, so as to have the front part of the bottom plate of the cooking chamber be positioned over bottom plate of the see-through member in response to the door being closed.

14. The microwave oven according to claim 13, wherein the front and top plates of the see-through member include a plurality of see-through holes which provide optical views into an interior of the cooking chamber, at least from locations in front of, both sides of and above the microwave oven.

15. The microwave oven according to claim 14, the see-through holes are formed across an entire area of the see-through member so as to allow an effective visual view of the interior of the cooking chamber.

16. The microwave oven according to claim 2, wherein:

the front part of the bottom plate of the cooking chamber is shaped in a form of a semi-circle, and the rear part of the bottom plate of the cooking chamber is shaped in a form of a semi-circle or a rectangle.

17. The microwave oven according to claim 2, further comprising:

a turntable for receiving the food thereon; and a rotating shaft which is coupled to the turntable to rotate the turntable, wherein:

the bottom plate of the cooking chamber includes a downwardly concave recess which receives the turntable, and the recess is provided with a through hole so as to couple the rotating shaft to the turntable therethrough.

18. The microwave oven according to claim 17, wherein the turntable is partially positioned on the front part of the bottom plate of the cooking chamber so as to have the through hole be positioned on a boundary line of the front and rear parts of the bottom plate of the cooking chamber.

19. The microwave oven according to claim 2, wherein the frame is sized so as not to obstruct the front opening of the cooking chamber.

20. The microwave oven according to claim 1, wherein the heating unit includes a magnetron which generates microwaves to cook the food.

* * * * *

UNITED STATES PATENT AND TRADEMARK OFFICE

CERTIFICATE OF CORRECTION

PATENT NO. : 6,956,191 B2 
APPLICATION NO. : 10/323739
DATED : October 18, 2005
INVENTOR(S) : Dae-Sung Han et al.

It is certified that error appears in the above-identified patent and that said Letters Patent is hereby corrected as shown below:

First Page, Col. 1 (Title), delete “PROJECTION” and insert --PROJECTING-- therefor.
Col. 9, Line 7, delete “see through” and insert --see-through-- therefor.
Col. 9, Line 17, after “opening” insert --around the--.
Col. 9, Line 52, after “claim 5” insert --wherein--.
Col. 10, Line 13, delete “from” and insert --form-- therefor.
Col. 10, Line 15, after “over” insert --the--.
Col. 10, Line 25, after “claim 14” insert --wherein--.

Signed and Sealed this

Twenty-first Day of November, 2006

JON W. DUDAS
*Director of the United States Patent and Trademark Office*